US010364619B2

(12) United States Patent
Smith

(10) Patent No.: US 10,364,619 B2
(45) Date of Patent: Jul. 30, 2019

(54) INTEGRAL ELECTRICALLY ISOLATED CENTRALIZER AND SWELL PACKER SYSTEM

(71) Applicant: ALASKAN ENERGY RESOURCES, INC., Anchorage, AK (US)

(72) Inventor: Lee Morgan Smith, Anchorage, AK (US)

( * ) Notice: Subject to any disclaimer, the term of this patent is extended or adjusted under 35 U.S.C. 154(b) by 40 days.

(21) Appl. No.: 16/155,438

(22) Filed: Oct. 9, 2018

(65) Prior Publication Data

US 2019/0040694 A1 Feb. 7, 2019

Related U.S. Application Data

(63) Continuation-in-part of application No. 15/160,961, filed on May 20, 2016, now Pat. No. 10,053,925.

(51) Int. Cl.

| | |
|---|---|
| ***E21B 17/10*** | (2006.01) |
| *E21B 10/26* | (2006.01) |
| *E21B 33/12* | (2006.01) |

(52) U.S. Cl.

CPC ..... *E21B 17/1078* (2013.01); *E21B 10/26* (2013.01); *E21B 33/12* (2013.01)

(58) Field of Classification Search

CPC ..... E21B 17/1078; E21B 33/1208

See application file for complete search history.

(56) References Cited

U.S. PATENT DOCUMENTS

| | | | |
|---|---|---|---|
| RE19,339 | E | 10/1934 | Vertson |
| 3,285,678 | A | 11/1966 | Garrett et al. |
| 3,322,217 | A | 5/1967 | Orr Cook |
| 3,420,323 | A | 1/1969 | Owens |
| 4,081,203 | A | 3/1978 | Fuller |
| 4,231,437 | A | 11/1980 | Swersky et al. |
| 4,277,869 | A | 7/1981 | Hartwell |
| 4,385,669 | A | 5/1983 | Knutsen |
| 4,610,316 | A | 9/1986 | Boaz |
| 4,664,206 | A | 5/1987 | Butler |
| 4,766,663 | A | 8/1988 | Milam |
| 5,330,016 | A | 7/1994 | Paske |
| 7,650,952 | B2 | 1/2010 | Evans et al. |

(Continued)

OTHER PUBLICATIONS

"Radial Tubular Forming Tool (RTF-13.38.)" Volant (Nov. 2014).
"Radial Tubular Forming Tool (RTF-9.63.)" Volant (Nov. 2014).
"Radial Tubular Forming Tool (RTF-7.0.)" Volant (Dec. 2015).

*Primary Examiner* — Kristyn A Hall
(74) *Attorney, Agent, or Firm* — Buskop Law Group, P.C.; Wendy Buskop

(57) ABSTRACT

A field created integral electrically isolated centralizer and swell packer system for wellbore tubulars having in series over the wellbore tubular, a first end ring, a swell packer portion over a first and second primer optionally with cured resin, a second end ring, wherein the end rings inhibit axial movement of the swell packer portion. Integral with the swell packer portion an electrically isolating centralizer; a cured resin bonded to the wellbore tubular filling all hollow spaces of the centralizer portion integrally forming a high strength bond, while excluding bonding to the first and second end rings, the cured resin configured to cure to a hardness of at least 50 shore A and withstand temperatures and pressures within a wellbore for at least twenty-four hours without melting, while specifically excluding a sand screen.

20 Claims, 15 Drawing Sheets

(56) References Cited

U.S. PATENT DOCUMENTS

| | | | | |
|---|---|---|---|---|
| 7,762,322 | B2 | 7/2010 | Andersen et al. | |
| 7,784,550 | B2 | 8/2010 | Nutley et al. | |
| 8,162,081 | B2 | 4/2012 | Ballard et al. | |
| 8,443,882 | B2 | 5/2013 | Barnard et al. | |
| 8,607,900 | B1 | 12/2013 | Smith | |
| 8,991,487 | B2 | 3/2015 | Levie et al. | |
| 9,145,746 | B1 | 9/2015 | Smith | |
| 9,151,118 | B2 | 10/2015 | Robson | |
| 9,151,119 | B1 | 10/2015 | Smith | |
| 2009/0229816 | A1 | 9/2009 | Lemme et al. | |
| 2010/0051349 | A1 | 3/2010 | Ballard | |
| 2010/0263880 | A1 | 10/2010 | Carter | |
| 2010/0276138 | A1 | 11/2010 | Wittman | |
| 2010/0300689 | A1 | 12/2010 | McRobb et al. | |
| 2011/0253457 | A1 | 10/2011 | Shen | |
| 2012/0145412 | A1 | 6/2012 | Andersen et al. | |
| 2012/0255786 | A1 | 10/2012 | Isenhour | |
| 2013/0000989 | A1 | 1/2013 | Sherrill | |
| 2014/0102728 | A1* | 4/2014 | Gamstedt ..... | E21B 33/1208 166/387 |
| 2014/0202770 | A1 | 7/2014 | Zaki et al. | |
| 2014/0246247 | A1 | 9/2014 | Smith | |

* cited by examiner

INTEGRAL ELECTRICALLY ISOLATED CENTRALIZER AND SWELL PACKER SYSTEM

CROSS-REFERENCE TO RELATED APPLICATIONS

The present application is a Continuation in Part of U.S. patent application Ser. No. 15/160,961 filed May 20, 2016, entitled "CENTRALIZER SYSTEM" which is now U.S. Pat. No. 10,053,925 issued on Aug. 21, 2018 (our reference 2051.018). This reference is hereby incorporated in its entirety.

FIELD

The present embodiments generally relate to an integral electrically isolated centralizer and swell packer system for use with wellbore tubulars.

BACKGROUND

A need exists for an integral electrically isolated centralizer and swell packer system that provides two different physical properties during operation to centralize and seal a drill string in production liner in a well bore.

A need exists for an electrically isolated centralizer and swell packer system configured to simultaneously (i) prevent axial movement of the centralizer portion about the wellbore tubular, (ii) prevent rotational movement of the centralizer portion while installed on the wellbore tubular, (iii) distribute load evenly preventing stress riser around the centralizer portion, and (iv) provide cathodic protection to the wellbore tubular without using a stop collar fastened to the tubular and (v) provide a wellbore seal using a swellable material of an integral swell packer portion.

The present embodiments meet these needs.

BRIEF DESCRIPTION OF THE DRAWINGS

The detailed description will be better understood in conjunction with the accompanying drawings as follows:

FIGS. 1A-1D depict a hollow blade embodiment of a centralizer portion of the invention while

FIG. 7A shows primer on a wellbore tubular before swellable material is installed and FIG. 7B shows the assembled invention.

Figure 1A:
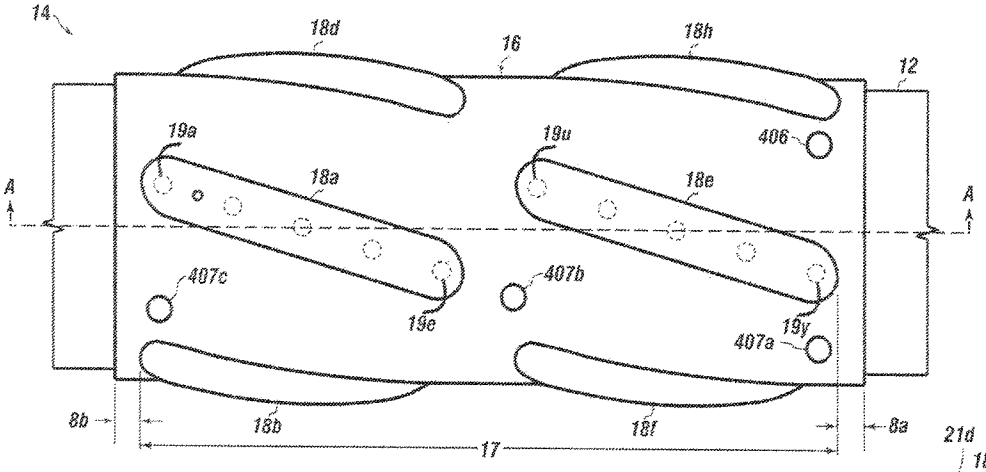

The present embodiments are detailed below with reference to the listed Figures.

DETAILED DESCRIPTION OF THE EMBODIMENTS

Before explaining the present integral device and method in detail, it is to be understood that the invention and method are not limited to the particular embodiments and that it can be practiced or carried out in various ways.

The invention relates to a field created integral electrically isolated centralizer and swell packer system for wellbore tubulars.

The integral centralizer and swell packer system having in series mounted over a wellbore tubular, a first primer and a second primer coated on the wellbore tubular.

Over the first primer is a first end ring and a swellable material.

A cured resin can be disposed over the first and second primer.

Over the second primer and optional cured resin is a swellable material.

A second end ring is attached to the swellable material over the primer and optional cured resin.

The first and second end rings inhibit axial movement of the swell packer portion.

Adjacent the second end ring over the wellbore tubular is installed and electrically isolating centralizer.

A liquid phase resin is pumped into spaces in the centralizer and blades forming a cured resin bonded to the wellbore tubular filling all hollow spaces integrally forming a high strength bond between the wellbore base tubular and the hollow tube portion of the electrically isolating centralizer but excluding contact with the first and second end rings.

The cured resin is configured to cure to a hardness of at least 50 shore A and withstand temperatures and pressures within a wellbore for at least twenty-four hours without melting.

The formed integral electrically isolated centralizer and swell packer system specifically excludes a sand screen.

In embodiments, hollow blades, hollow pads, and solid blades can be oriented helically around a longitudinal axis of the integral electrically isolated centralizer and swell packer system.

The injectable liquid curable resin and swellable encapsulation and shape shifting material can be selected to withstand temperatures and pressures within a wellbore for twenty-four hours without melting or degrading.

A feature of the invention is that the centralizer portion can simultaneously do several functions, (a) prevent axial movement and rotational movement while installed on the wellbore base tubular, (b) distribute load evenly around the centralizer portion, and (c) provide cathodic protection to the wellbore base tubular without using a stop collar with screws while the swell packer portion can provide a stable seal in the production liner.

A benefit of the invention is that this integral system can be formed in the field.

Another benefit of the invention is that the electrically isolated integral centralizer and swell packer system can be created at a lower cost than commercially available two part assemblies reducing leaks due to the integral assembly.

This invention has the benefit enabling the cost to remove hydrocarbons to be lower, which ultimately provides a lower gas price which can help people on a fixed budget.

Another benefit of the invention is that this integral centralizer and swell packer system is stronger than single component centralizers or single component swell packers lasting longer without creating environmental incidents downhole.

A benefit of the invention is that the centralizer portion can be made such that the centralizer exhibits two or three different physical properties simultaneously due to the incorporation of different materials into the centralizer. In embodiments, the blades can be made of one material, such as steel, and a hollow tube of the centralizer can be made of a different material, such as a reinforced polymer. The flutes of the centralizer can be coated in a second material, such as a composite graphite to move fluid up well easier than the blades for example.

Yet another benefit of the invention is that no collar with screws is needed to hold the tubular to the centralizer. By eliminating the need for screw holes and screws, the invention can seal more securely preventing well fluid spills and toxic leaks.

In embodiments, the electrically isolated integral centralizer and swell packer system can be used in wellbores having a drilled hole size of 5 inches to 36 inches. However, other drilled hole sizes can be used for the system if the outer diameter of the blades of the centralizer are varied in outer diameter to being larger or smaller.

Specific structural and functional details disclosed herein are not to be interpreted as limiting, but merely as a basis of the claims and as a representative basis for teaching persons having ordinary skill in the art to variously employ the present invention.

The term "swell" (and similar terms, such as, "swellable," "swelling," etc.) is used herein to indicate an increase in volume of a material. A seal element can expand outward without swelling (e.g., as in inflatable or compression-set packers, etc.). However, if the material is to be considered swollen, the seal element material itself must increase in volume.

The term "high strength bond" for epoxy resins is used herein to indicate a tensile strength of 3,316 psi (22.9 MPa) per ASTM D638.

Preferably, the swellable material swells when it is contacted with a particular swelling fluid (e.g., oil, gas, other hydrocarbons, water, etc.) in the well. The swelling fluid may already be present in the well, or it may be introduced after installation of the packer in the well, or it may be carried into the well with the packer, etc. The swellable material could instead swell in response to exposure to a particular temperature, or upon passage of a period of time, or in response to another stimulus.

Cured Resin:

Epoxy resins can be used herein as a liquid injectable material to fill hollows in the centralizer and beneath the end rings.

Epoxies, also known as polyepoxides, are a class of reactive prepolymers and polymers which contain epoxide groups. Epoxy resins can be reacted (cross-linked) either with themselves through catalytic homopolymerisation, or with a wide range of co-reactants including polyfunctional amines, acids (and acid anhydrides), phenols, alcohols and thiols. These co-reactants can often be referred to as hardeners or curatives, and the cross-linking reaction can be commonly referred to as curing. Reaction of polyepoxides with themselves or with polyfunctional hardeners forms a thermosetting polymer, often with high mechanical properties, temperature and chemical resistance.

In embodiments, usable plastic injectable curable resins can be polypropylene, polyethyelene homopolymers and copolymers thereof.

In embodiments, the injectable curable resin can be an ethylene propylene diene monomer rubber or other synthetic rubbers.

The injectable liquid can be configured to harden "to cure" a resin with a hardness of at least 50 shore A and withstand temperatures and pressures within a wellbore for at least twenty-four hours without melting or degrading after hardening within each of the plurality of hollow blades and annulus.

Swellable Material

In embodiments, a swellable encapsulation and shape shifting material can be used in the swell packer portion of the invention.

The swellable encapsulation and shape shifting material can be an elastic polymer, ethylene propylene diene monomer rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber or polynorbornene. The elastic polymer can swell in contact with and by absorption of hydrocarbons so that the packer expands. Additional options can incorporate into the elastic polymer a polyvinyl chloride, such as methyl methacrylate, acrylonitrile, ethylacetate or other polymers expanding by contact with oil.

Additionally, elastic polymers can be acrylonitrile, hydrogenated nitrile, chloroprene, ethylene vinylacetate rubber, silicone, ethylene propylene diene monomer, butyl, chlorosulphonated polyethylene, polyurethane, a thermoplastic or a thermosetting polymer. The usable elastic polymer can have a higher resistance towards hydrocarbons than rubber and swells only to a small degree upon exposure to hydrocarbons.

In embodiments, both oil swell and water swell polymers can be used. Several elastic polymers can have a considerable absorption of hydrocarbons without absorption of water, and the polymers in the present invention are predominantly hydrophobic. By immersion in a hydrocarbonaceous medium, hydrocarbons can migrate into the polymer which swells upon absorption of these materials.

Centralizer

In embodiments, the centralizer portion can generally be tubular having a hollow annulus and a longitudinal axis.

In embodiments, the centralizer portion can range in length from 2 inches to 48 inches and have an outer diameter from 3 inches to 36 inches.

In embodiments, the centralizer portion can be made from a metal, such as steel, or a reinforced polymer with a hardness in excess of 50 shore A.

The centralizer portion can have an outer surface, which can support the blades, and an inner surface, which can slide over a wellbore base tubular having a pin end and a box end.

The blade portion of the centralizer portion can be from 20 percent to 100 percent the length of the centralizer portion or range from 1 percent to 400 percent the length of the centralizer.

The blade portion can have hollow blades, solid blades or pads, which can extend away from the surface of the blade portion of the centralizer.

In embodiments, the blades can be continuous from one end of the blade portion to the other end.

In embodiments, the blades can be discontinuous from one end of the blade portion to the other.

In embodiments, the cured resin can be injected in a liquid state into the blades and between the centralizer portion and the wellbore base tubular.

In an embodiment, the cured resin can be layered over the outer surface of the blade portion forming a resin layer with a defined flexibility and durometer.

In embodiments, blades can be secured to the epoxy or polymeric system, such as using the cured resin that can be disposed on the outer surface.

In embodiments, the blade portion can have a blade surface. The blades can be either hollow or solid, or the pads can be either hollow or solid extending away from the blade surface at least the same distance as the thickness of the hollow tube of the centralizer portion.

In embodiments, a wellbore gap can be formed between the blades and the production liner of the wellbore or casing of a well.

In embodiments, the blades can be formed from the same material as the blade surface and can be integral with the blade surface.

In embodiments, an epoxy or similar curable resin can be layered to the blade surface forming a resin layer with a defined flexibility and durometer, and then the blades can be secured to the epoxy or resin layer on the blade surface.

In embodiments, the blade surface can be formed from the same material as the outer surface of the centralizer portion.

In embodiments, the blades can be a different metal from the material of the blade surface.

In embodiments, the blades and blade surface can be different metals from the outer surface of the centralizer portion enabling two or three different physical properties to be used simultaneously for the centralizer portion.

For example, the blades can be formed from a material that provides a hard surface and the blade surface can be formed from a material that provides cathodic protection and electrical isolation from the wellbore base tubular.

In other embodiments, the blade surface can be a material that allows some flexing while the blades can be formed from a different hard material.

In embodiments, the injectable material in the hollow blades embodiment of the invention can impart a fourth physical property for the centralizer system all simultaneously.

In embodiments, the blades can be disposed equidistantly around the blade surface of the centralizer.

In embodiments, the blade portion of the centralizer can have blades that extend away from the outer surface of the centralizer portion from ⅛ of an inch to ¼ of an inch.

In embodiments, the blades can extend from ½ inch to 8 inches longitudinally down the blade portion.

In embodiments, the blades can be offset from each other.

In embodiments, the blades can be formed in rows or in patterns, such as X patterns or H patterns.

In embodiments, the blades can be formed in zones or preset areas of the centralizer portion. Some areas can be discrete from other portions or zones.

In embodiments, the blades can be helically disposed around the centralizer portion in parallel with each other and in parallel to a longitudinal axis of the centralizer portion.

In embodiment, the blades can be curved.

In embodiments, from 2 blades to 25 blades can be used that can extend from one end of the centralizer portion to the other end. In embodiments, from 3 blades to 12 blades can be used, wherein each blade can be contiguous from a first end to a second end of the blade portion. In an embodiment, one blade can be used on the centralizer portion.

The wall thickness of each blade can range from 1/16 of an inch to 1 inch.

In embodiments, the blades can be hollow with thru-holes. The thru-holes can enable the hollow blades to receive a liquid injectable curable resin that hardens to a cured resin.

The liquid injectable material can be injected through the thru-holes while in a liquid state, once in the hollow blades, the liquid injectable material hardens within the hollow blades forming a different property from the metal the blade can be constructed from.

In embodiments, the injectable material can impart both a different flexibility and a different durometer and a different ionic property from the outer material containing the liquid injectable material.

In embodiments, from 1 thru-hole to 5 thru-holes can be used with each hollow blade.

In embodiments, all blades can be injected with the liquid injectable material simultaneously enabling hardening to occur simultaneously and quick creation of the centralizer portion.

In embodiments, ports can be formed in each hollow blade or in the centralizer hollow tube. The ports can be configured to receive a portion of injectable material that forms the cured resin system. As the injectable material hardens forming a cured resin, the thru-holes and ports close.

In embodiments, flutes can extend into hollow tube or into the blades of the centralizer without penetrating to the annulus to provide a different form of flexibly simultaneously with a particulate moving pathway as the centralizer is used. The flutes can extend into the hollow body portion of the centralizer portion from 2 percent to 90 percent of the thickness of the blade portion.

Primer

In embodiments, primer can be layered onto the centralizer portion and/or the wellbore base tubular which can be secured to the centralizer portion and to the swellable material of the swell packer portion.

In embodiments, the primer can be a metal substrate primer such as CHEMOSIL® 211, from Lord Corporation.

In embodiments, the primer layers can each be a discontinuous layer to each other.

In embodiments, each primer layer can range in thickness from 0.001 inches to 0.25 inches.

In embodiments, primer can be applied to an inner diameter of the centralizer portion.

In embodiments, the primer can be applied to an outer surface of a wellbore base tubular and then liquid phase of the cured resin can be applied over the primer.

In embodiments, a portion of the wellbore base tubular can be first sanded and then primer applied. The annulus portion of the centralizer can be slid over the wellbore base tubular forming a tight connection with the primer and then liquid phase of the cured resin injected filling allow hollow spaces. In embodiments, the hollow blades or pads can be pre-filled with the liquid phase of the cured resin.

Figure 1B:
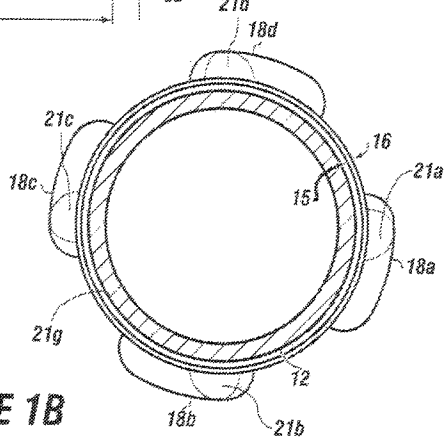
Figure 1C:
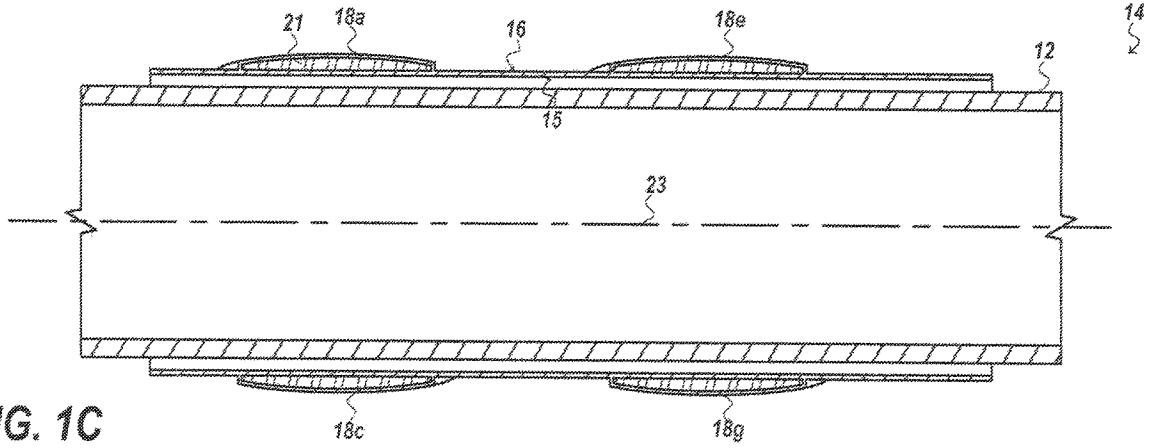
Figure 1D:
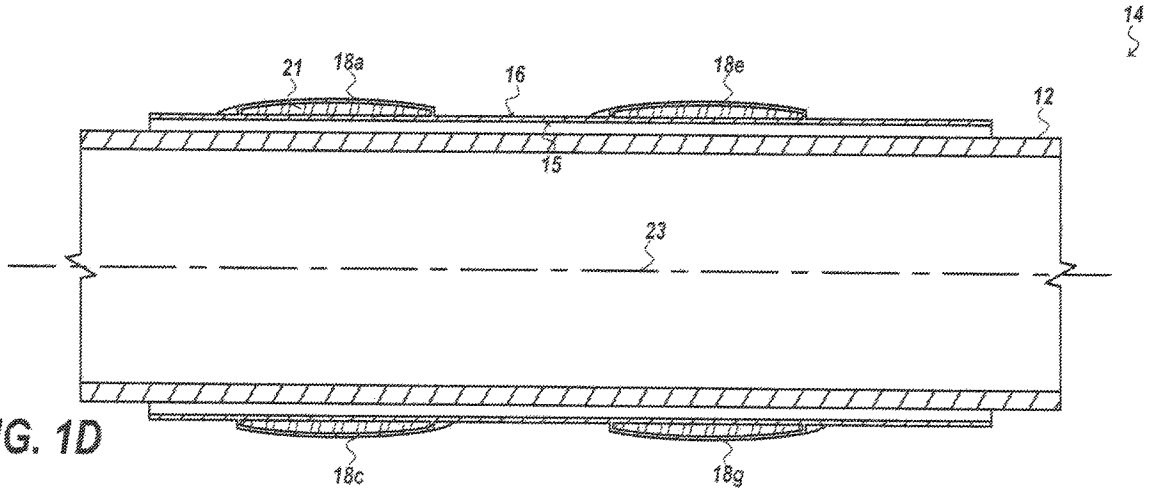
Figure 1E:
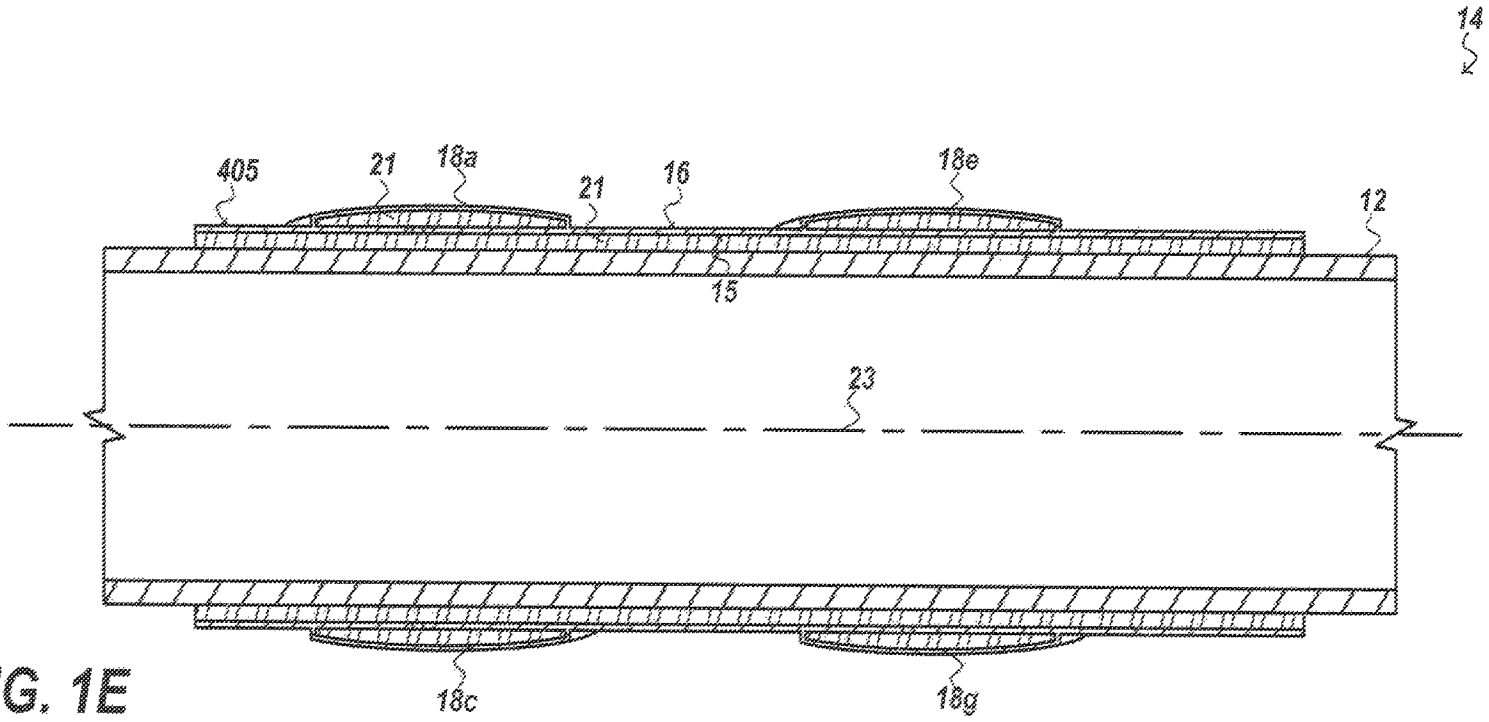
FIG. 1E depicts the hollow blade filled with cured resin.

Turning now to the Figures, FIGS. 1A-1D depict a hollow blade embodiment of a centralizer portion of the invention while FIG. 1E depicts the hollow blade filled with cured resin.

FIG. 1A is a side view with cutline A-A.

FIG. 1B is a cross sectional view along the cutline A-A.

FIG. 1C is a cross sectional view of a hollow blade version of the centralizer portion before an injectable material that becomes the cured resin is added.

FIG. 1D is a cross sectional view of another embodiment of the hollow blade version of the centralizer portion before an injectable material has been added.

FIG. 1E is a cross sectional view of a hollow blade version of the centralizer portion filled with cured resin.

Figure 7A:
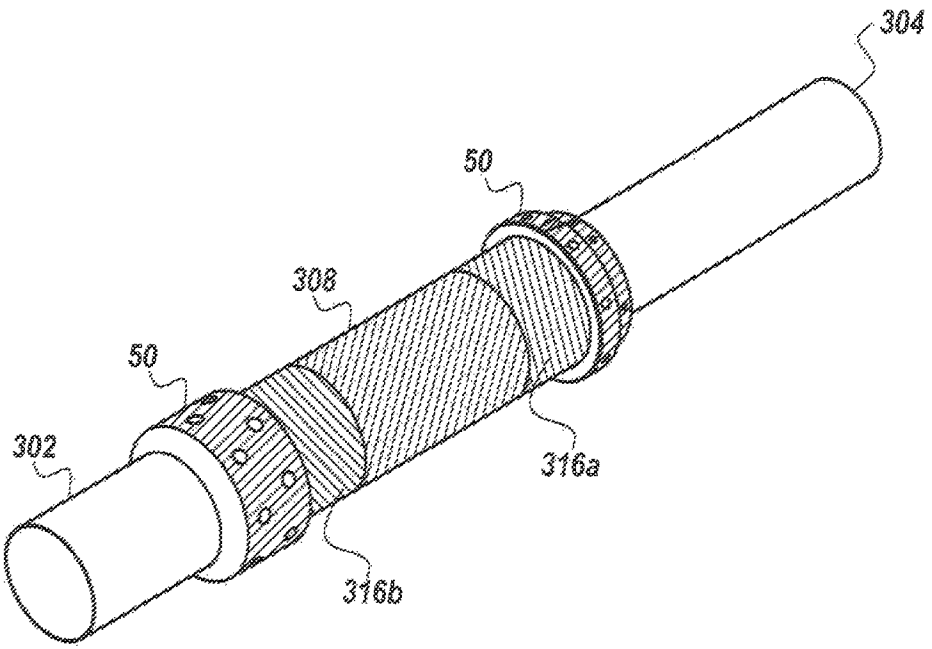
FIGS. 7A and 7B depict the swell packer portion before and after assembly.
Figure 7B:
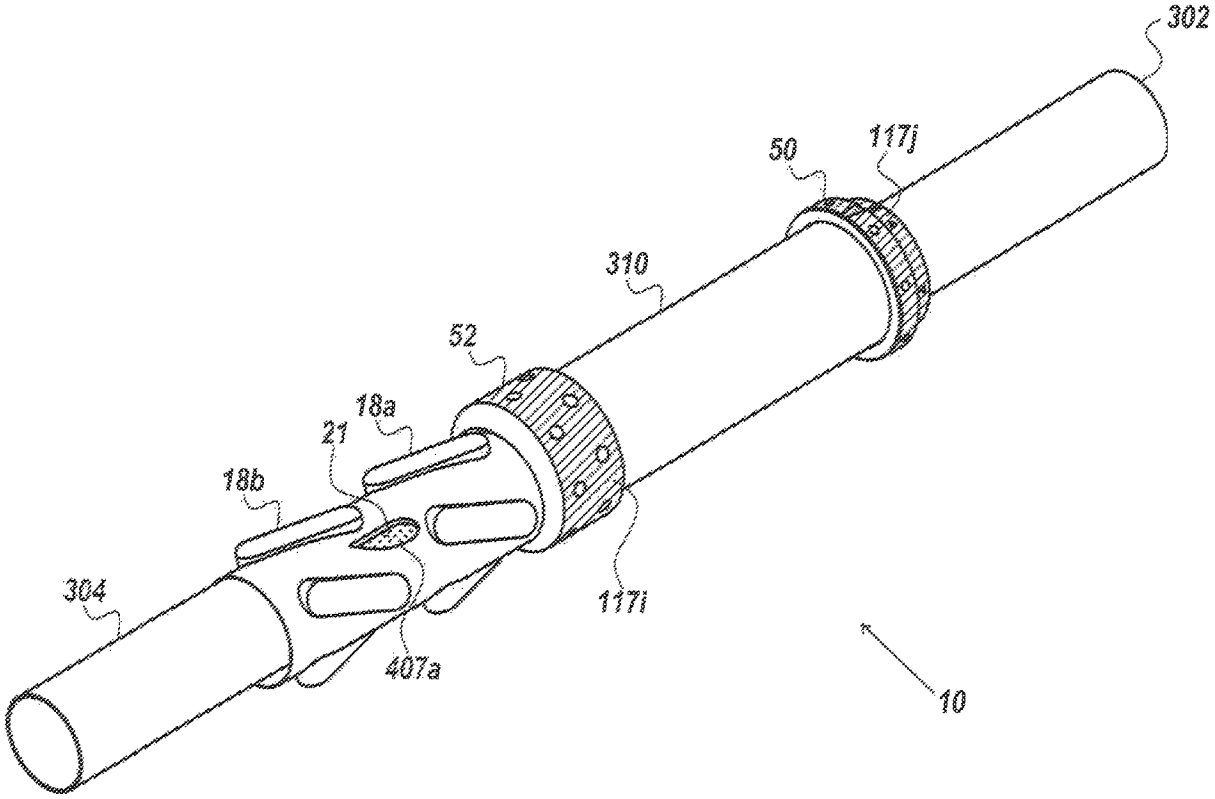

FIGS. 1A-1E show a centralizer portion 14 of the electrically isolating centralizer with swell packer system 10 (the assembled system is shown FIG. 7B).

Figure 4A:
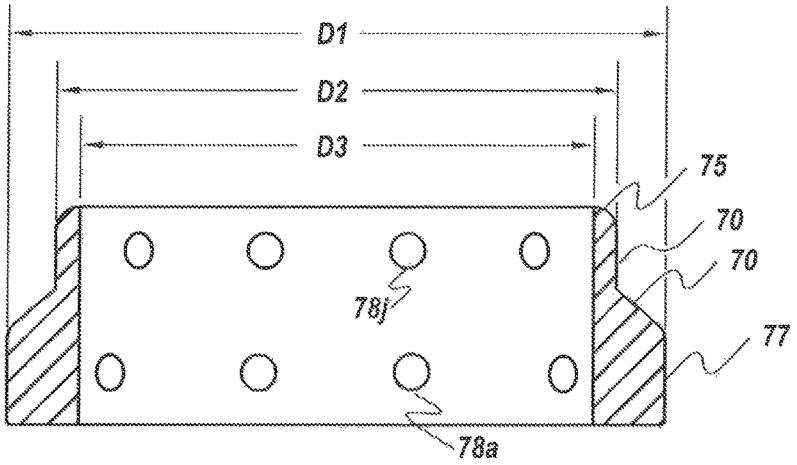
FIG. 4A-4C depict an embodiment of end rings usable in the invention.
Figure 4B:
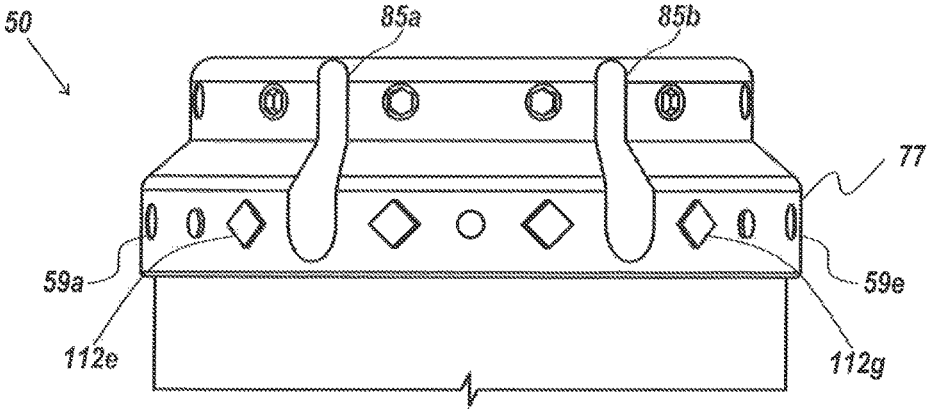
Figure 4C:
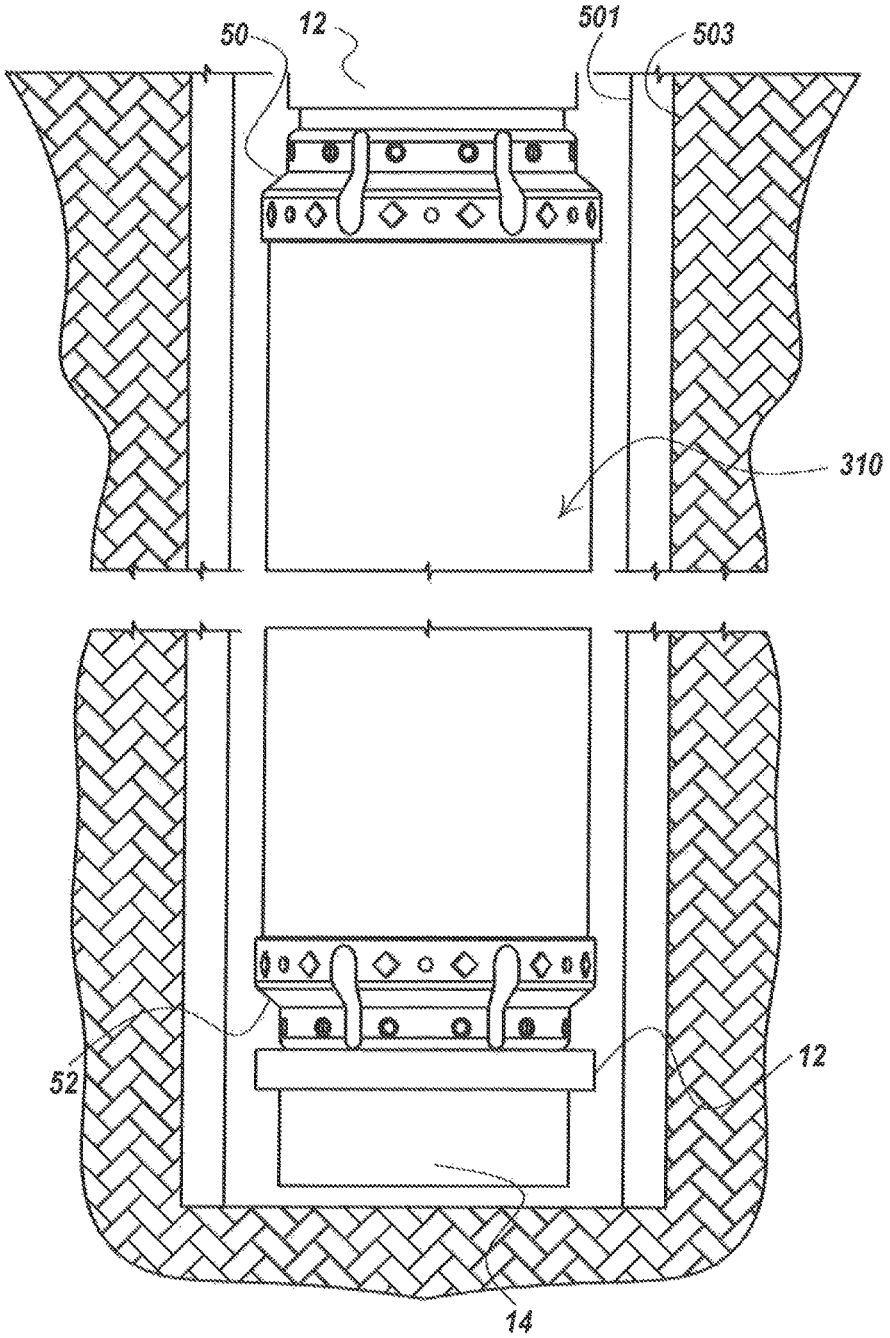

The centralizer portion 14 can have an inner surface 15 and an outer surface 16 for engaging a production liner 501 of a wellbore 503 which is shown in FIG. 4C.

Returning to FIGS. 1A-E, the centralizer portion 14 is positioned over a wellbore base tubular 12. The centralizer portion can have a longitudinal axis 23.

In embodiments, the centralizer portion of the system can have at least one extension 88*a*, 88*b* connected to a blade portion 17. Each extension 88*a*, 88*b* can be connected on opposite sides of the blade portion 17.

In embodiments, the blade portion 17 can have a plurality of hollow blades 18*a*-18*h*. Each hollow blade can separately extend from the outer surface 16.

In embodiments, the blade portion and one or more of the extensions can be a one piece integral unit, which means that the unit, the assembly can be seamlessly formed.

In embodiments, a plurality of thru-holes 19*a*-19*y* can be formed in the plurality of hollow blades 18*a*-18*h*. In embodiments, at least one hollow blade can have at least one thru-hole.

In embodiments, an injectable material that forms the cured resin 21 can be inserted through a fill port 406.

A plurality of exit ports 407*a*, 407*b*, 407*c* can be used allowing excess liquid injectable material that forms the cured resin 21 to leave the hollow blades ensuring all hollow sections of the hollow blades and blade portion are completely filled.

In embodiments, the injectable material 21 which is when cured is referred to as "cured resin 21" is a material configured to harden to a cured resin with a hardness of at least 50 shore A and withstand temperatures and pressures within a wellbore for at least twenty-four hours without melting or degrading after hardening within each of the plurality of hollow blades and other hollow sections of the centralizer portion.

The injectable material forming the cured resin 21 can be at least one of: a polymer system and an epoxy system. Each polymer system or epoxy system can be configured to swell to a hardness of at least 50 shore A and withstand temperatures and pressures within a wellbore for at least twenty-four hours without melting after swelling.

FIG. 1E shows the cured resin 21 not only in the hollow blades 18*a*-18*g*, but also mounted between the hollow tube 405 of the centralizer portion and the wellbore base tubular 12.

The field created integral electrically isolated centralizer and swell packer system 10 is formed when an electrically isolating centralizer portion 14 is installed over can receive a wellbore base tubular 12 longitudinally. It should be noted that the wellbore base tubular has a box end and a pin end as shown in FIGS. 7A and 7B.

The field created integral electrically isolated centralizer and swell packer system 10 can be configured to simultaneously (i) prevent axial movement of the centralizer portion about the wellbore base tubular, (ii) prevent rotational movement of the centralizer portion while installed on the wellbore base tubular. (iii) distribute load evenly preventing stress riser around the centralizer portion, and (iv) provide cathodic protection to the wellbore base tubular without using a stop collar fastened to the wellbore base tubular while the swell packer portion can provide a sealing engagement with a production liner.

FIG. 1B-1E show the inner surface 15 of the centralizer portion.

In embodiments, from 1 thru-hole to 8 thru-holes per blade, and all the numbers in between can be used.

In embodiments, the injectable material forming the cured resin 21 can be at least one of: a plastic, a rubber, a polymeric material, an elastomer, and a composite.

In embodiments, usable composites for the injectable material that forms the cured resin 21 can be blends of the aforementioned resins with another component, such as a fiber. Fibers, such as nanocarbon fiber tubes, fiberglass, and similar fibers can be blended into the injectable material.

In FIG. 1A, the plurality of hollow blades are shown as helically oriented around the longitudinal axis 23 of the electrically isolating centralizer portion 14.

FIGS. 2A-2D depict a solid blade embodiment of a centralizer portion with flutes in the crest of each of the blades.

Figure 2A:
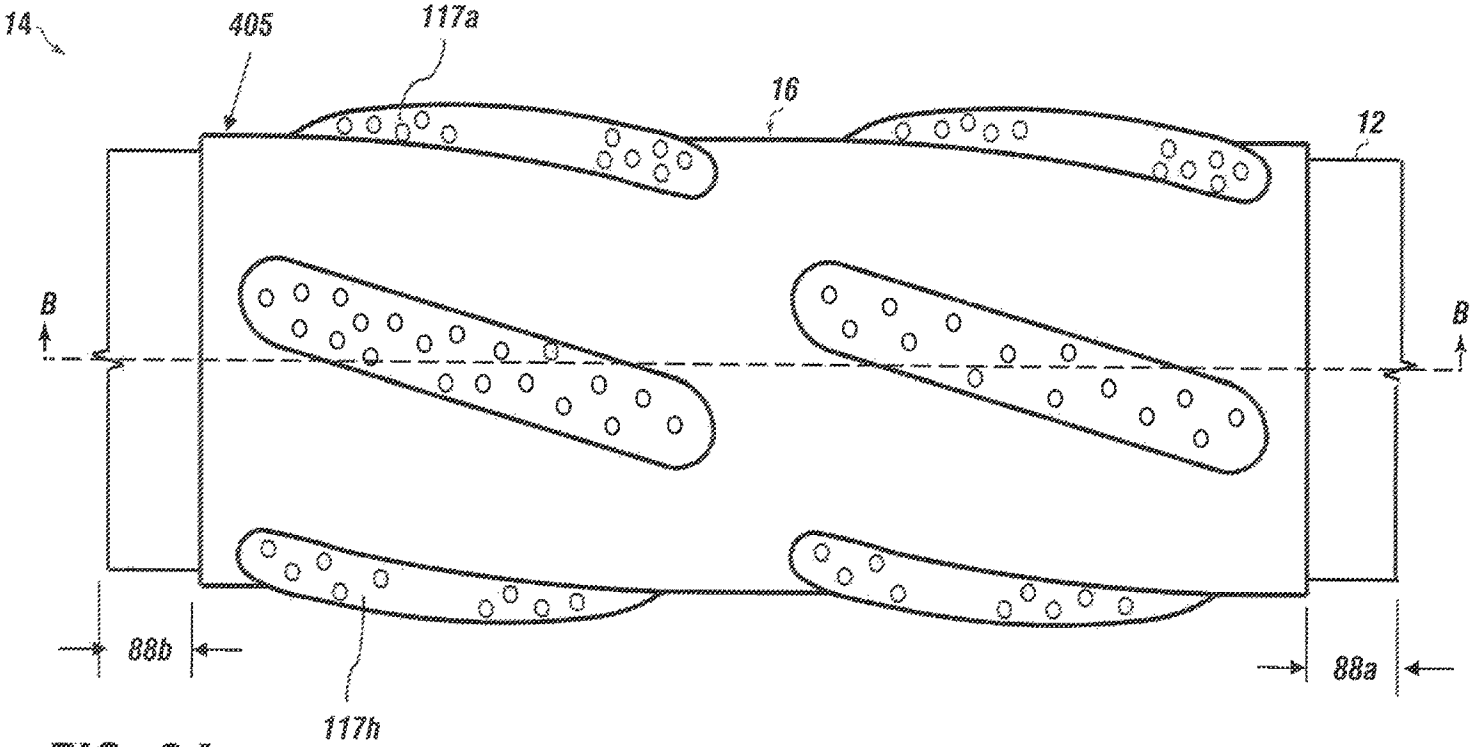
FIGS. 2A-2D depict a solid blade embodiment of a centralizer portion with FIG. 2D having a coating on the solid blades.

FIG. 2A depicts a side view of the centralizer portion with cutline B-B with at least one of: a diamond abrasion resistant hardfacing 117*a*-*h* disposed on: at least one crest, at least one end, or at least one pair of ends of blades of the centralizer portion.

Figure 2B:
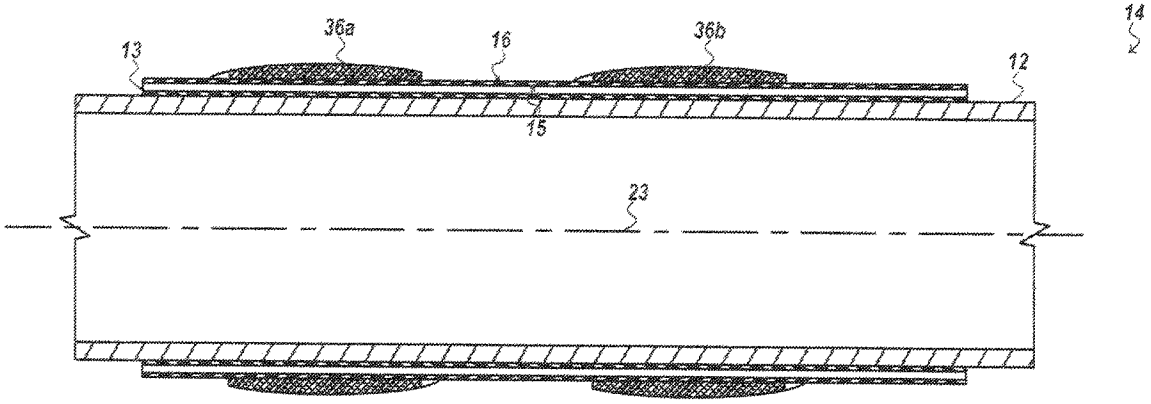

FIG. 2B shows a cross sectional view along the cutline B-B with an injectable phase of cured resin 21 prior to curing between the hollow tube and the wellbore base tubular 12.

Figure 2C:
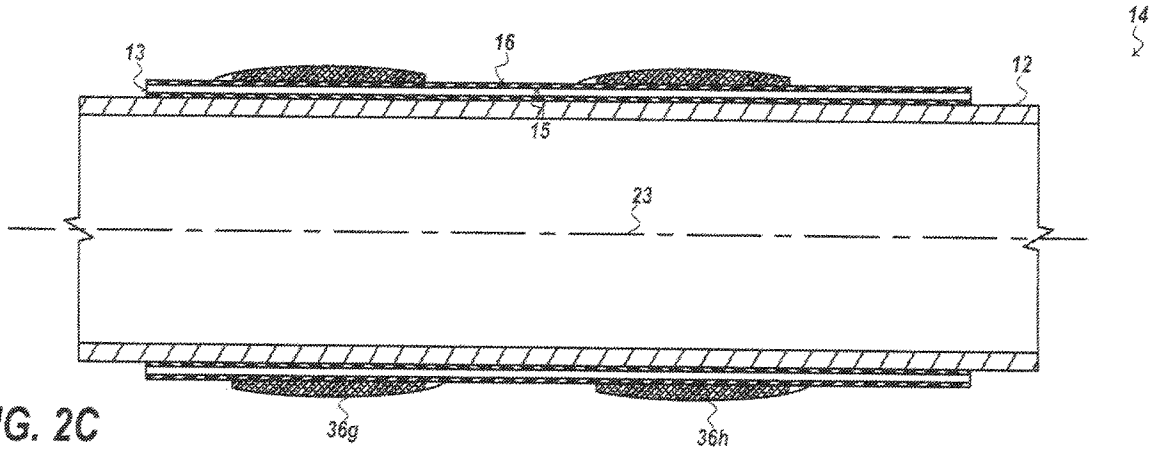

FIG. 2C is a cross sectional view of another embodiment of the solid blade portion of the centralizer portion with flutes in the crests of the blade and an injectable phase of cured resin 21.

Figure 2D:
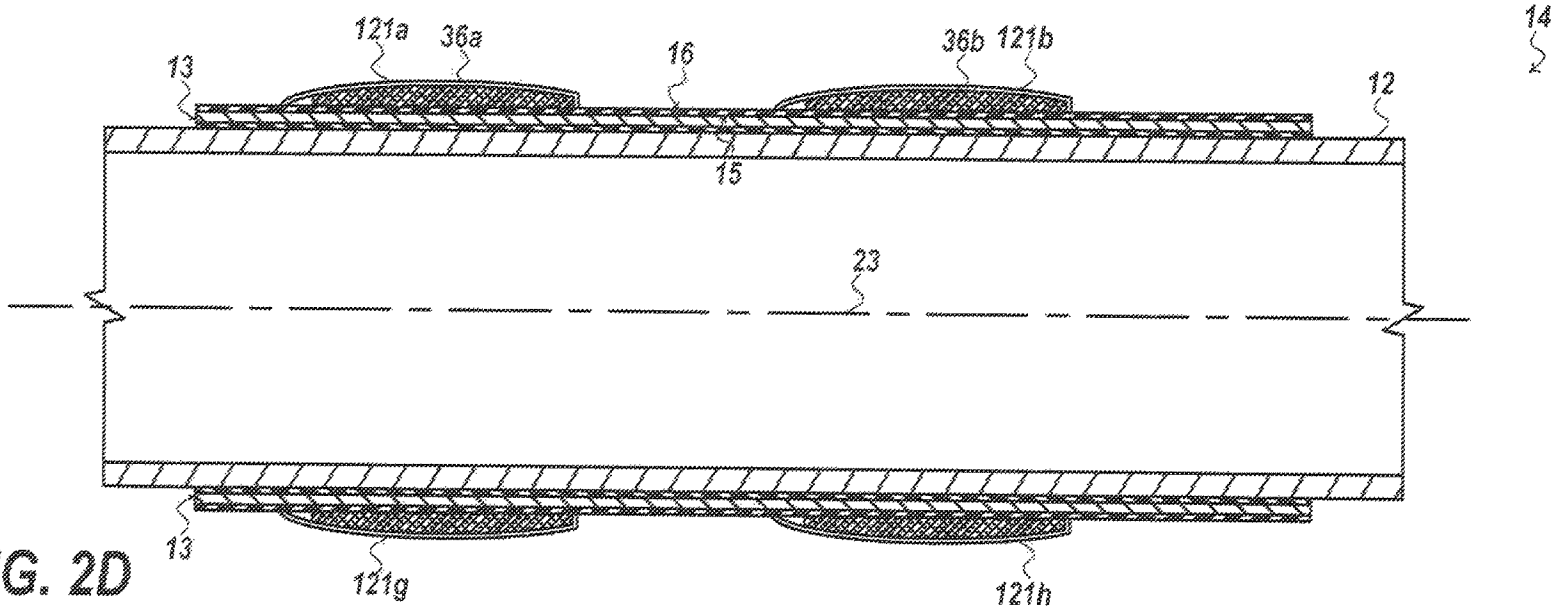

FIG. 2D shows a cross sectional view of a solid blade portion of the centralizer system with an injectable material 21 between the hollow body and the wellbore base tubular and a coating.

FIGS. 2A-2D show different embodiments of a solid blade centralizer portion 14 with an inner surface 15 and an outer surface 16 and a longitudinal axis 23.

In embodiments, the solid blade centralizer portion 14 can have at least one extension 88*a*, 88*b* on opposite sides of the solid blades 36*a*-*h*.

In embodiments, the plurality of solid blades 36*a*-36*h*, can each extend from the outer surface 16 as a rectangular shape, as a curvilinear shape, or as a generally rectangular or square shape with rounded edges.

In embodiments, an injectable phase of cured resin 21 can be installed in different places in the centralizer portion 14 such as between a wellbore base tubular 12 and the hollow body 405.

The injectable material is a liquid phase of the cured resin 21. The injectable material of the cured resin can be at least one of: a polymer system and an epoxy system. Each polymer system or epoxy system can be configured to cure to a hardness of at least 50 shore A and withstand temperatures and pressures within a wellbore for at least twenty-four hours without melting after curing without swelling.

In embodiments, an injectable phase of cured resin 21 can fill an annulus 13 between the wellbore base tubular 12 and the hollow body 405.

The injectable phase of cured resin 21 can be configured to harden to a hardness of at least 50 shore A and withstand temperatures and pressures within a wellbore for at least twenty-four hours without melting after hardening.

In embodiments, the solid blade centralizer portion 14 can be configured to simultaneously (i) prevent axial movement of the solid blade centralizer portion about the wellbore base tubular, (ii) prevent rotational movement of the solid blade centralizer portion while installed on the wellbore base tubular, (iii) distribute load evenly preventing stress riser around the solid blade centralizer portion, and (iv) provide cathodic protection to the wellbore base tubular without using a stop collar fastened to the wellbore base tubular.

In embodiments, the plurality of solid blades 36 can be helically oriented around the longitudinal axis 23 of the solid blade centralizer portion.

FIG. 2D shows a coating 121*a*-121*d* encapsulating each solid blade or partially disposed on each solid blade, wherein the coating is selected from the group: a curable polyurethane, or the cured resin 21 and combinations thereof.

Figure 3:
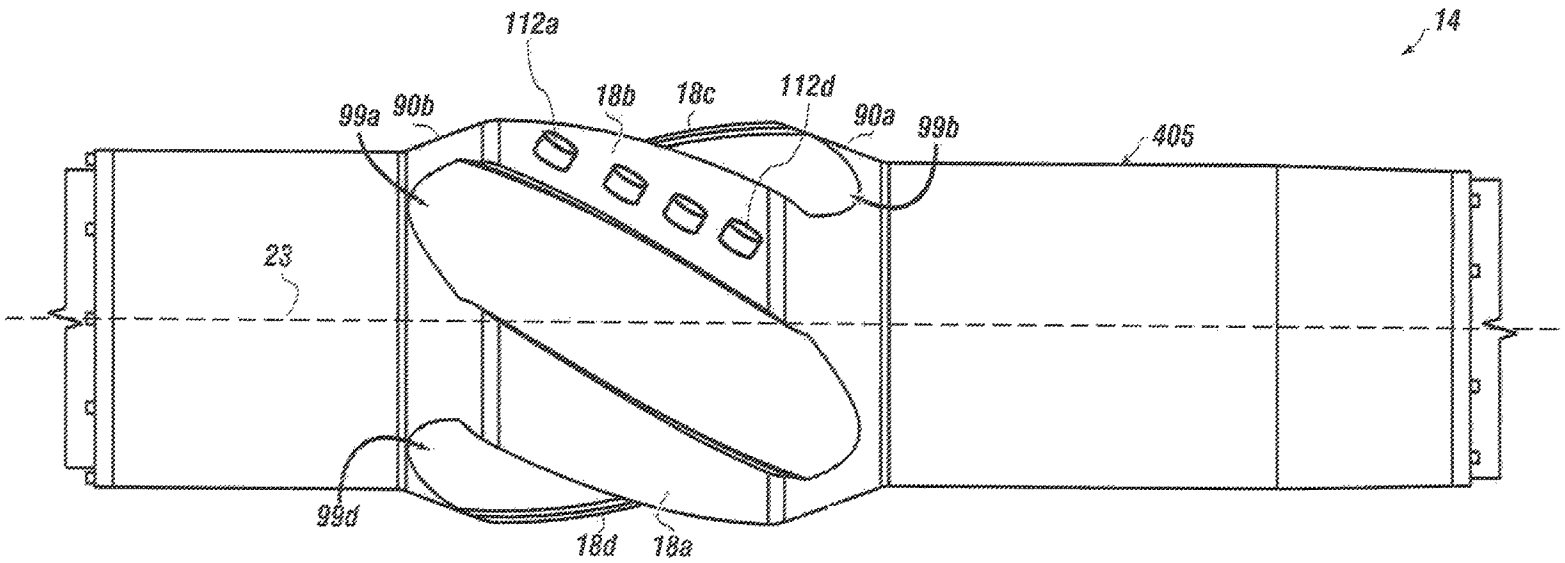
FIG. 3 depicts an embodiment of the centralizer portion with flutes disposed between blades.

FIG. 3 depicts an embodiment of the centralizer portion 14 with flutes 99*a*-99*d* in the centralizer hollow body portion disposed between blades 18*a*-18*d* on the outer surface of the centralizer portion.

In embodiments, the plurality of flutes 99*a*, 99*b* and 99*d* can be formed partly in sloped edges 90*a*, 90*b* of the hollow body 405 of the centralizer portion simultaneously.

The flutes can have varying geometries. Flutes can be ellipsoid. Flutes can be a combination of tapers. In a side profile, the flute may have a "scoop" shape, facilitating dirt removal.

In embodiments, the flutes can be triangular in cross section or trapezoidal in shape.

In embodiments, the plurality of flutes can connect to the sloped edges. Each sloped edge 90*a*, 90*b* of an end ring can have a slope formed at an angle from 1 degree to 50 degrees from the longitudinal axis 23.

On each blade and be installed friction reducing diamond cutter inserts 112*a,b,c,d* can be installed on the hollow blades 18*a,b,c,d* circumferentially and spaced apart symmetrically or near-symmetrically around the end ring. The diamond cutter inserts aid in cutting the wellbore as the drill string is inserted the well. The diamond cutter inserts also aid in protecting the swellable member from being snagged or torn by the well or by drill cuttings. In an embodiment, the blades can be solid blades and the friction reducing diamond cutters can be installed thereon.

The number of diamond cutter inserts is not limiting to the use; however, more diamond cutter inserts increase the cutting ability of the end rings. The diamond cutter inserts can be symmetrically or near-symmetrically located across the centerline of the second ring or can be in an offset pattern from one another across the centerline of the second ring. The diamond cutter inserts can have a diameter between 50% and 100% of the width of the second ring. The diamond cutter inserts can also be granular and coated on the face of the second ring. Each diamond cutter insert can extend away from the end ring by 0.001 millimeters to 3 millimeters. The diamond cutter inserts are useful for sliding the swell packer into the wellbore and for preventing the swell packer from becoming stuck in the wellbore.

FIGS. 4A through 4C depict embodiments of end rings usable in the invention and an embodiment with the pair of end rings around the swell packer section installed in a production liner in a wellbore.

In FIG. 4A depicts first end ring 50.

The first end ring 50 has an outer surface 77 having a plurality of threaded holes 78*a*-78*j*.

The first end ring has an initial diameter D1, a first sloped shoulder 72 extending towards a smaller diameter outer surface 70.

A second sloped shoulder 75 extends from the smaller diameter outer surface 70 toward an inner surface. The smaller diameter outer surface 70 has a diameter D2.

The end ring has a hollow center as shown with an inner diameter D3.

In embodiments, the inner diameter D3 is 20% to 40% less than the initial diameter D1.

FIG. 4B shows another version of the first end ring 50 with two end ring flutes 85*a*, 85*b* longitudinally formed in the first end ring.

On each of the two end rings friction reducing diamond cutter inserts 112*e*-112*g* can be installed on the outer surface 77 circumferentially and spaced apart symmetrically or near-symmetrically around the end ring. The diamond cutter inserts aid in cutting the wellbore as the drill string is inserted the well. The diamond cutter inserts also aid in protecting the swellable member 106 from being snagged or torn by the well or by drill cuttings.

The first and second end rings can have carbide material on the outer surface as a layer. In one or more embodiments the carbide material can be a layer and/or can be one or more buttons of polycrystalline material, shown as 59*a*-59*e* in FIG. 4B such as a diamond material installed on the outer surface 77; a PDC material, such as PDC buttons; or PDC cutters, such as those from Guilin Star Diamond Superhard Materials Co., Ltd. of China, which can aid in reaming the wellbore.

FIG. 4C shows two end rings 50 and 52 assembled on either side of a swell packer portion 310 with the integral centralizer portion 14 in a production liner 501 in a wellbore 503.

In embodiments The first and second end rings of the invention can be identical.

The number of diamond cutter inserts is not limiting to the use; however, more diamond cutter inserts increase the cutting ability of the end rings. The diamond cutter inserts can be symmetrically or near-symmetrically located across the centerline of the second ring or can be in an offset pattern from one another across the centerline of the second ring. The diamond cutter inserts can have a diameter between 50% and 100% of the width of the second ring. The diamond cutter inserts can also be granular and coated on the face of the second ring. Each diamond cutter insert can extend away from the end ring by 0.001 millimeters to 3 millimeters. The diamond cutter inserts are useful for sliding the swell packer into the wellbore and for preventing the swell packer from becoming stuck in the wellbore.

Figure 5:
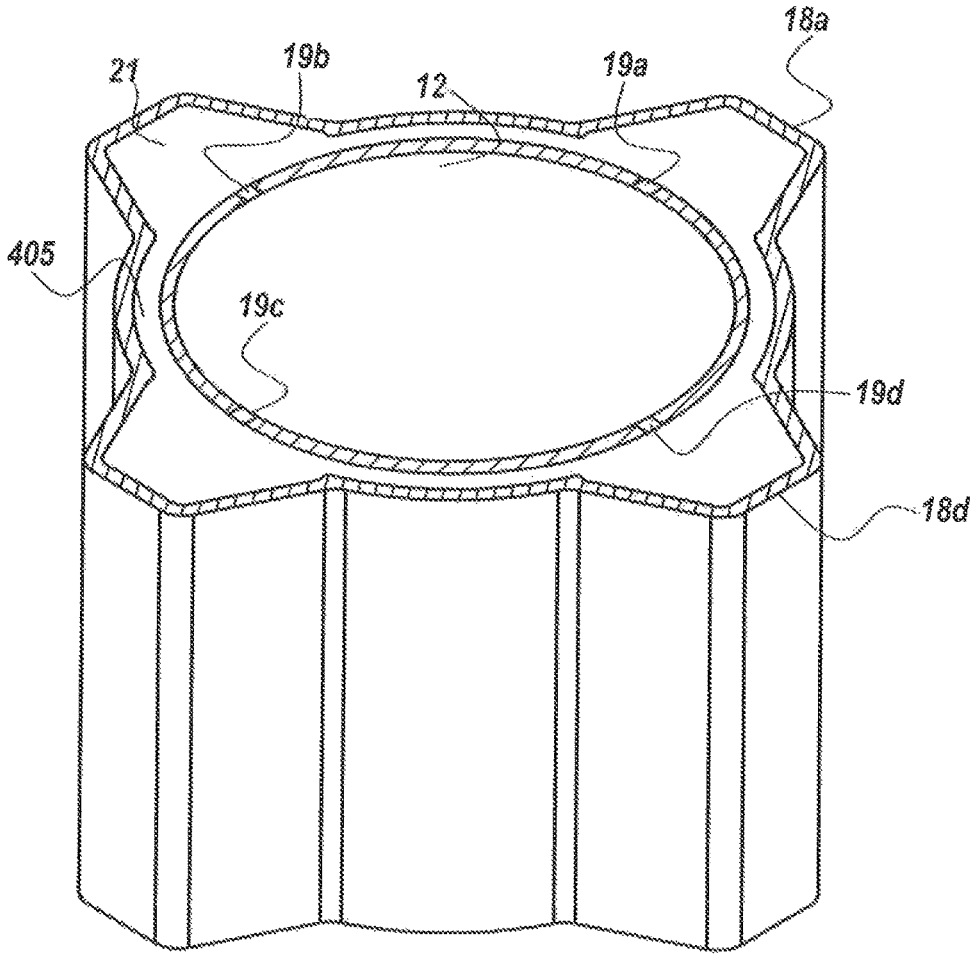
FIG. 5 depicts a cross sectional view of the centralizer portion with hollow blades filled with cured resin around a wellbore base tubular.

FIG. 5 depicts a cross sectional view of the centralizer portion 14 with hollow tube 405 that opens into hollow blades 18*a*-18*d*. Each hollow blade is filled with cured resin 21 that forms a bond around the wellbore base tubular 12.

A plurality of thru-holes 19*a*-19*d* can be formed in the plurality of hollow blades. In embodiments, at least one hollow blade can have at least one thru-hole.

Figure 6:
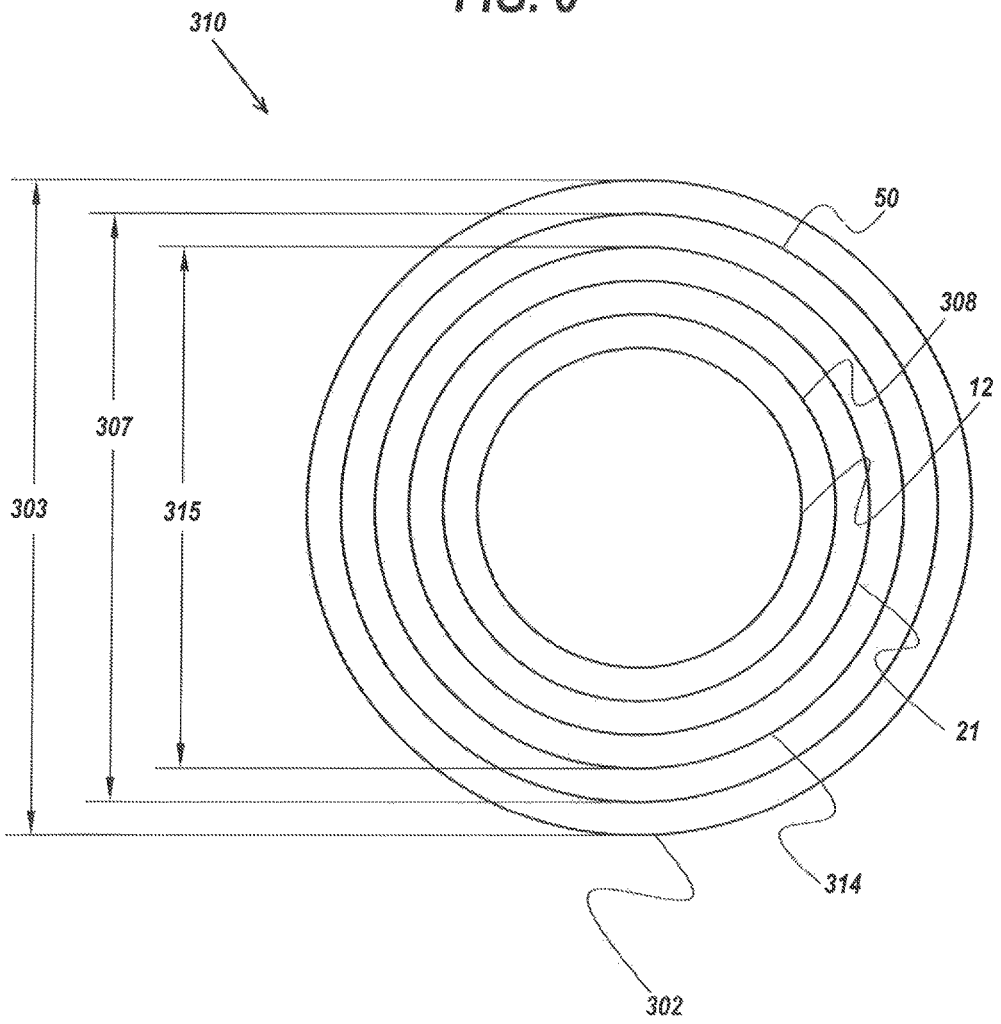
FIG. 6 depicts a cross sectional view of the swell packer portion of the invention with cured resin.

FIG. 6 depicts a cross sectional view of the swell packer portion 310 of the invention with the swell packer portion 310 held by a first end ring 50 to the wellbore base tubular 12.

FIG. 6 shows the wellbore base tubular 12 having the first primer 308 disposed on the wellbore base tubular 12.

Over the first primer 308 is cured resin 21,

As second primer is installed adjacent but not over the first primer.

The second primer is not labelled in this FIG. 6.

Over the cured resin 21 is the swellable material 314.

The first end ring 50 has a first end ring inner diameter 307. The first end ring slides over the wellbore base tubular coated with first and second primer and the first end ring 50 fastens to one end of the swellable material 314.

A second end ring 52 (not shown in this figure) fastens on an opposite end of the swellable material 314 over a second portion of the first primer.

The box end 302 of the wellbore base tubular 12 is shown.

The box end has a box end diameter 303 that is larger than the first end ring inner diameter 307.

The first end ring inner diameter 307 is larger than the swellable material inner diameter 315 of the swellable material 314.

FIG. 7A shows the swell packer portion prior to assembly with a first primer portion 316*a* coated thereon and another first primer portion 316*b* coated thereon before swellable material is installed over the coated material.

FIG. 7A shows a second primer 308 coated on the wellbore base tubular between the two first primer portions 316*a* and 316*b*.

An injectable material that forms the cured resin 21 is installed to completely coat and encapsulate the first and second primers.

The box end 301 of the well base tubular is shown with the first end ring 50 adjacent the box end.

The pin end 304 is labelled.

The second end ring 52 is shown.

FIG. 7B shows the assembled invention, the field created integral electrically isolated centralizer and swell packer system 10.

A box end 302 has a first end ring 50 with the swell packer portion 310 affixed to the first end ring and the second end ring 52 affixed on an opposite side of the swell packer portion.

The centralizer portion 14 is shown positioned adjacent the second end ring and between the second end ring 52 and the pin end 304.

Exit port 407*a* is also depicted as well as hollow blades 18*a* and 18*b* filled with cured resin are shown on the centralizer portion.

FIG. 7B shows a diamond abrasion resistant hardfacing 117*i*, 117*j* on a portion of an outer surface of each end ring 117*i*, 117*j*.

Figure 8A:
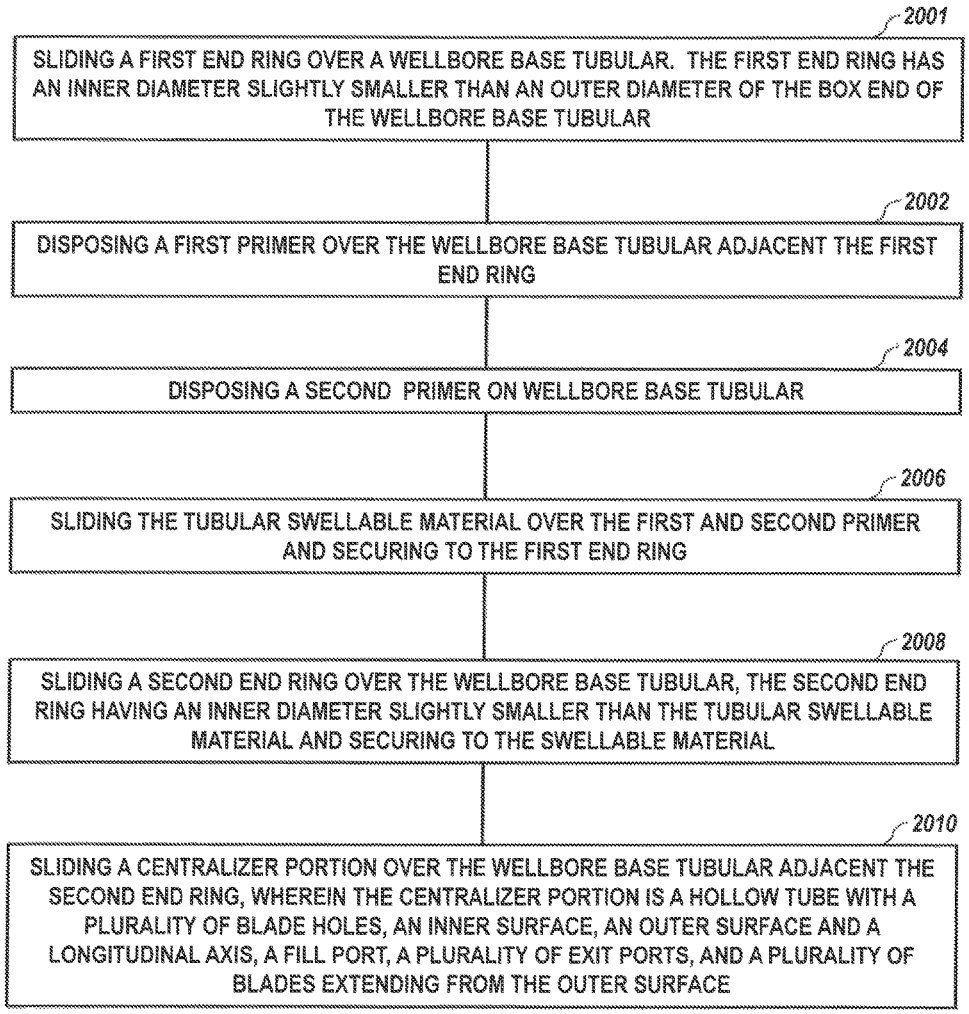
FIGS. 8A and 8B depict a series of method steps to create the electrically isolated centralizer with swell packer system.
Figure 8B:
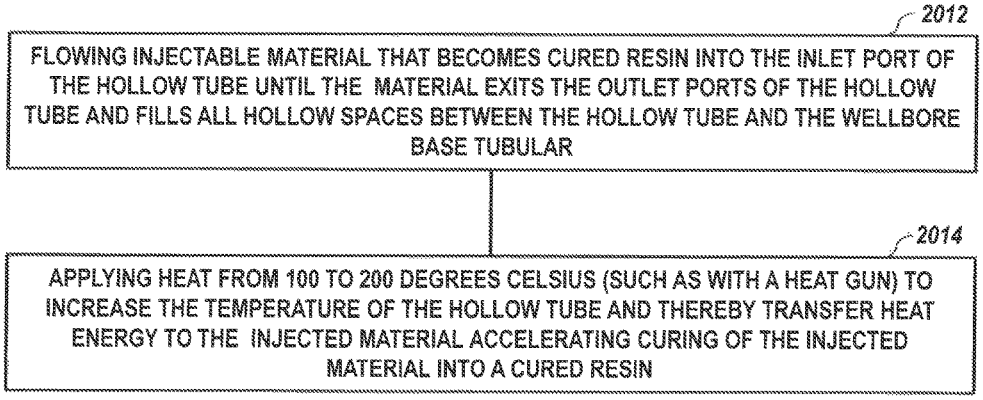

FIG. 8A-B depicts a series of method steps to create the electrically isolated centralizer with swell packer system.

FIG. 8A-B shows that the invention is for building in the field rather than a shop, a bonded integral centralizer and swell packer system for a wellbore base tubular at a well site, such as offshore Alaska.

In FIG. 8. Step 2001 involves sliding a first end ring over a wellbore base tubular towards the box end. The first end ring has an inner diameter slightly smaller than an outer diameter of the box end of the wellbore base tubular.

In embodiments, each end ring can have two beveled edges that mate at a generally planar surface which is 90 degrees to the longitudinal axis of the wellbore base tubular.

Step 2002 involves disposing a first primer over the wellbore base tubular adjacent the first end ring.

Step 2004 involves disposing a second primer on wellbore base tubular.

Step 2006 involves sliding the tubular swellable material over the first and second primer and securing to the first end ring.

Step 2008 involves sliding a second end ring over the wellbore base tubular, the second end ring having an inner diameter slightly smaller than the tubular swellable material and securing to the swellable material.

Step 2010 contemplates sliding a centralizer portion over the wellbore base tubular adjacent the second end ring, wherein the centralizer portion is a hollow tube with a plurality of blade holes, an inner surface, an outer surface and a longitudinal axis, a fill port, a plurality of exit ports, and a plurality of blades extending from the outer surface.

Step 2012 involves flowing injectable material that becomes cured resin into the inlet port of the hollow tube until the material exits the outlet ports of the hollow tube and fills all hollow spaces between the hollow tube and the wellbore base tubular.

Step 2014 describes applying heat from 100 to 200 degrees Celsius (such as with a heat gun) to increase the temperature of the hollow tube and thereby transfer heat energy to the injected material accelerating curing of the injected material into a cured resin.

In embodiments, a field created integral electrically isolated centralizer and swell packer system has an integral assembly has a wellbore base tubular that can have a box end and a pin end and a first end ring with a first end ring inner diameter slightly smaller than a box end inner diameter, the first end ring mounted adjacent the box end around the wellbore base tubular.

In embodiments, a swell packer portion comprising has a first primer disposed on the wellbore base tubular adjacent the first end ring, a cured resin formed from a liquid phase injectable material disposed on the first primer, and a tubular swellable material disposed on the cured resin, the tubular swellable material having a swellable material inner diameter slightly less than the first end ring inner diameter, the tubular swellable material selected to expand on exposure to at least one triggering fluid used in the wellbore forming a seal in the wellbore upon expansion; the tubular swellable material mounted to the first end ring over the first primer In embodiments, the field created integral electrically isolated centralizer and swell packer system also has a second primer disposed on the wellbore base tubular as part of the swell packer portion, a second end ring disposed on the second primer and around the wellbore base tubular securing to the swell packer portion opposite the first end ring, wherein the first and second end rings inhibit axial movement of the swell packer portion on the wellbore base tubular.

In embodiments, the field created integral electrically isolated centralizer and swell packer system also has an electrically isolating centralizer portion mounted over the wellbore base tubular, the electrically isolated centralizer portion configured to centralize the wellbore base tubular in a production liner in a wellbore.

In embodiments the electrically isolated centralizer portion has a hollow tube with fill port and at least one exit port having an outer surface, a plurality of blades extending from the outer surface, each blade positioned over a thru-hole, and a cured resin bonded to the wellbore base tubular filling all hollow spaces integrally forming a high strength bond between the wellbore base tubular and the hollow tube, while excluding the first and second end rings, the cured resin configured to cure to a hardness of at least 50 shore A and withstand temperatures and pressures within a wellbore for at least twenty-four hours without melting, the formed integral electrically isolated centralizer and swell packer system specifically excluding a sand screen in the field created integral formed system.

In embodiments, the field created integral electrically isolated centralizer and swell packer system can have a plurality of blades that can be formed from identical material forming the outer surface of the centralizer portion.

In embodiments, the field created integral electrically isolated centralizer and swell packer system can have a plurality of blades that are helically oriented around the longitudinal axis of the centralizer portion.

In embodiments, the field created integral electrically isolated centralizer and swell packer system can have at least one sloped edge integrally connecting each of the plurality of blades to the hollow body, wherein the at least one sloped edge has a slope formed at an angle from 1 degree to 50 degrees from the longitudinal axis of the centralizer portion.

In embodiments, the field created integral electrically isolated centralizer and swell packer system, can have a plurality of flutes, each flute positioned between a pair of blades, each flute formed between a pair of blades.

In embodiments, the field created integral electrically isolated centralizer and swell packer system can have cured resin and bonded wellbore base tubular that simultaneously (i) prevents axial movement of the centralizer portion about the wellbore base tubular, (ii) prevents rotational movement of the centralizer portion while installed on the wellbore base tubular, (iii) distributes load evenly preventing stress around the centralizer portion, and (iv) provides cathodic protection to the wellbore base tubular without using a stop collar fastened to the wellbore base tubular.

In embodiments, the field created integral electrically isolated centralizer and swell packer system can have a plurality of blades that are offset from each other.

In embodiments, each blade of the field created integral electrically isolated centralizer and swell packer system has friction reducing diamond cutter inserts.

In embodiments, each flute of the field created integral electrically isolated centralizer and swell packer system can be tapered at each end of the flute.

In embodiments, the blades of the field created integral electrically isolated centralizer and swell packer system can extend away 1% to 50% the thickness of the hollow tube from the outer surface of the centralizer portion.

In embodiments, each blade of the field created integral electrically isolated centralizer and swell packer system, can have a length from 1 times to 10 times greater than each blade width.

In embodiments, the field created integral electrically isolated centralizer and swell packer system can have a first row of blades that are offset longitudinally 10 degrees to 60 degrees from a second row of blades disposed longitudinally along the outer surface of the hollow tube of the centralizer portion.

In embodiments, each blades of the field created integral electrically isolated centralizer and swell packer system, can form an arc from 1 to 30 degrees from one end of the blade to the other end of the blade.

In embodiments, each blade of the field created integral electrically isolated centralizer and swell packer system can have a hollow center longitudinally formed between the outer surface and a crest of each blade.

In embodiments, the tubular swellable material of the field created integral electrically isolated centralizer and swell packer system, can have either: an oil-swellable rubber, a natural rubber, a polyurethane rubber, an acrylate/butadiene rubber, a butyl rubber (IIR), a brominated butyl rubber (BIIR), a chlorinated butyl rubber (CIIR), a chlorinated polyethylene rubber (CM/CPE), an isoprene rubber, a chloroprene rubber, a neoprene rubber, a butadiene rubber, a styrene/butadiene copolymer rubber (SBR), a sulphonated polyethylene (PES), chlor-sulphonated polyethylene (CSM), an ethylene/acrylate rubber (EAM, AEM), an epichlorohydrin/ethylene oxide copolymer rubber (CO, ECO), an ethylene/propylene copolymer rubber (EPM), ethylene/propylene/diene terpolymer (EPDM), a peroxide crosslinked ethylene/propylene copolymer rubber, a sulphur crosslinked ethylene/propylene copolymer rubber, an ethylene/propylene/diene terpolymer rubber (EPT), an ethylene/vinyl acetate copolymer, a fluoro silicone rubber (FVMQ), a silicone rubber (VMQ), a poly 2,2,1-bicyclo heptene (polynorbornene), an alkylstyrene polymer, a crosslinked substituted vinyl/acrylate copolymer, derivatives thereof, or combinations thereof; or a water-and-oil-swellable material, and wherein the water-and-oil-swellable material comprises a nitrile rubber (NBR), an acrylonitrile/butadiene rubber, a hydrogenated nitrile rubber (HNBR), a highly saturated nitrile rubber (HNS), a hydrogenated acrylonitrile/butadiene rubber, an acrylic acid type polymer, poly(acrylic acid), polyacrylate rubber, a fluoro rubber (FKM), a perfluoro rubber (FFKM), derivatives thereof, or combinations thereof.

In embodiments, the field created integral electrically isolated centralizer and swell packer can have flutes that extend into the hollow body portion of the centralizer portion from 2 percent to 90 percent of the thickness of the blade portion.

In embodiments, the field created integral electrically isolated centralizer and swell packer system, can have end rings what each include at least one of: one or more buttons of polycrystalline material, installed on an outer surface of each end ring, and friction reducing diamond cutter inserts installed on the outer surface of each end ring.

In embodiments, the field created integral electrically isolated centralizer and swell packer system, can have a plurality of flutes for each end ring, each end ring formed in parallel with the longitudinal axis of the swell packer portion.

In embodiments, the field created integral electrically isolated centralizer and swell packer system, can have at least one of: a diamond abrasion resistant hard facing disposed on at least one crest, end, or pair of ends of blades of the centralizer portion, and on a portion of an outer surface of each end ring.

In embodiments, the field created integral electrically isolated centralizer and swell packer system, can have a coating encapsulating each blade or partially disposed on each blade, wherein the coating is selected from the group: a curable polyurethane, or the cured resin and combinations thereof.

EXAMPLE 1

A field created integral electrically isolated centralizer made from a metal, such as steel, and swell packer system has an integral assembly.

The integral assembly has a wellbore base tubular having a box end and a pin end.

The integral assembly has a first end ring with a first end ring inner diameter of 2 inches slightly smaller than a box end inner diameter of 1.9 inches, the first end ring mounted adjacent the box end around the wellbore base tubular.

The integral assembly also has a swell packer portion.

The swell packer portion has a first primer made out of CHEMOSIL® 211 disposed on the wellbore base tubular adjacent the first end ring.

The swell packer portion has a cured resin made out of polypropylene formed from a liquid phase injectable material disposed on the first primer, such as the LORD® 7701 adhesion enhancer/surface modifier along with epoxy and urethane adhesives.

The swell packer portion also has a tubular swellable material made out of ethylene propylene diene monomer rubber and disposed on the cured resin, the tubular swellable material having a swellable material inner diameter slightly less than the first end ring inner diameter, the tubular swellable material selected to expand on exposure to at least one triggering fluid used in the wellbore forming a seal in the wellbore upon expansion; the tubular swellable material mounted to the first end ring over the first primer.

The integral assembly has a second primer, such as the LORD® 7701 adhesion enhancer/surface modifier along with epoxy and urethane adhesives, disposed on the wellbore base tubular as part of the swell packer portion.

The integral assembly also has a second end ring disposed on the second primer and around the wellbore base tubular securing to the swell packer portion opposite the first end ring, wherein the first and second end rings inhibit axial movement of the swell packer portion on the wellbore base tubular.

The integral assembly has an electrically isolating centralizer portion mounted over the wellbore base tubular, the electrically isolated centralizer portion configured to centralize the wellbore base tubular in a production liner in a wellbore.

The electrically isolated centralizer portion has a hollow tube with a fill port and at least one exit port having an outer surface.

The electrically isolated centralizer portion has 4 helical blades extending from the outer surface, each blade positioned over a thru-hole.

The electrically isolated centralizer portion has a cured resin made out of dicyclopentadiene (DCPD) a family of co-monomers, such as PROXIMA® Thermoset Resins, and bonded to the wellbore base tubular filling all hollow spaces integrally forming a high strength bond between the wellbore base tubular and the hollow tube, while excluding the first and second end rings, the cured resin configured to cure to a hardness of at least 50 shore A and withstand temperatures and pressures within a wellbore for at least twenty-four hours without melting, the formed integral electrically isolated centralizer and swell packer system specifically excluding a sand screen in the field created integral formed system.

EXAMPLE 2

A field created integral electrically isolated centralizer made from a reinforced polymer with a hardness in excess of 50 shore A, and swell packer system has an integral assembly.

The integral assembly has a wellbore base tubular having a box end and a pin end.

The integral assembly has a first end ring with a first end ring inner diameter of 1.95 inches slightly smaller than a box end inner diameter of 1.7 inches, the first end ring mounted adjacent the box end around the wellbore base tubular.

The integral assembly also has a swell packer portion.

The swell packer portion has a first primer, such as the LORD® 7701 adhesion enhancer/surface modifier along with epoxy and urethane adhesives, disposed on the wellbore base tubular adjacent the first end ring.

The swell packer portion has a cured resin made out of polyethyelene homopolymers formed from a liquid phase injectable material disposed on the first primer.

The swell packer portion also has a tubular swellable material made out of styrene butadiene and disposed on the cured resin, the tubular swellable material having a swellable material inner diameter slightly less than the first end ring inner diameter, the tubular swellable material selected to expand on exposure to at least one triggering fluid used in the wellbore forming a seal in the wellbore upon expansion; the tubular swellable material mounted to the first end ring over the first primer.

The integral assembly has a second primer, such as the LORD® 7701 adhesion enhancer/surface modifier along with epoxy and urethane adhesives disposed on the wellbore base tubular as part of the swell packer portion.

The integral assembly also has a second end ring disposed on the second primer and around the wellbore base tubular securing to the swell packer portion opposite the first end ring, wherein the first and second end rings inhibit axial movement of the swell packer portion on the wellbore base tubular.

The integral assembly has an electrically isolating centralizer portion mounted over the wellbore base tubular, the electrically isolated centralizer portion configured to centralize the wellbore base tubular in a production liner in a wellbore.

The electrically isolated centralizer portion has a hollow tube with a fill port and at least one exit port having an outer surface.

The electrically isolated centralizer portion has 3 curved blades extending from the outer surface, each blade positioned over a thru-hole.

The electrically isolated centralizer portion has a cured resin made out of polyethyelene homopolymers and bonded to the wellbore base tubular filling all hollow spaces integrally forming a high strength bond between the wellbore base tubular and the hollow tube, while excluding the first and second end rings, the cured resin configured to cure to a hardness of at least 50 shore A and withstand temperatures and pressures within a wellbore for at least twenty-four hours without melting, the formed integral electrically isolated centralizer and swell packer system specifically excluding a sand screen in the field created integral formed system.

While these embodiments have been described with emphasis on the embodiments, it should be understood that within the scope of the appended claims, the embodiments might be practiced other than as specifically described herein.

What is claimed is:

1. A field created integral electrically isolated centralizer and swell packer system as an integral assembly comprising:

(i) a wellbore base tubular having a box end and a pin end;

(ii) a first end ring with a first end ring inner diameter smaller than a box end inner diameter, the first end ring mounted adjacent the box end around the wellbore base tubular;

(iii) a swell packer portion comprising:

(1) a first primer disposed on the wellbore base tubular adjacent the first end ring;

(2) a swell packer cured resin formed from a liquid phase injectable material disposed on the first primer; and (3) a tubular swellable material disposed on the cured resin, the tubular swellable material having a swellable material inner diameter less than the first end ring inner diameter, the tubular swellable material selected to expand on exposure to at least one triggering fluid used in the wellbore forming a seal in the wellbore upon expansion; the tubular swellable material mounted to the first end ring over the first primer;

(iv) a second primer disposed on the wellbore base tubular as part of the swell packer portion;

(v) a second end ring disposed on the second primer and around the wellbore base tubular securing to the swell packer portion opposite the first end ring, wherein the first and second end rings inhibit axial movement of the swell packer portion on the wellbore base tubular;

(vi) an electrically isolating centralizer portion mounted over the wellbore base tubular, the electrically isolated centralizer portion configured to centralize the wellbore base tubular in a production liner in a wellbore, the electrically isolated centralizer portion comprising:

(1) a hollow tube with fill port and at least one exit port having an outer surface;

(2) a plurality of blades extending from the outer surface, each blade positioned over a thru-hole;

(3) a centralizer portion cured resin bonded to the wellbore base tubular filling all hollow spaces integrally forming a high strength bond between the wellbore base tubular and the hollow tube, while excluding the first and second end rings, the cured resin configured to cure to a hardness of at least 50 shore A and withstand temperatures and pressures within a wellbore for at least twenty-four hours without melting, the formed integral electrically isolated centralizer and swell packer system specifically excluding a sand screen in the field created integral formed system.

2. The field created integral electrically isolated centralizer and swell packer system of claim 1, wherein the plurality of blades are formed from identical material forming the outer surface of the centralizer portion.

3. The field created integral electrically isolated centralizer and swell packer system of claim 1, wherein the plurality of blades are helically oriented around the longitudinal axis of the centralizer portion.

4. The field created integral electrically isolated centralizer and swell packer system of claim 1, comprising at least one sloped edge integrally connecting each of the plurality of blades to the hollow body, wherein the at least one sloped edge has a slope formed at an angle from 1 degree to 50 degrees from the longitudinal axis of the centralizer portion.

5. The field created integral electrically isolated centralizer and swell packer system of claim 4, comprising a plurality of flutes, each flute positioned between a pair of blades, each flute formed between a pair of blades.

6. The field created integral electrically isolated centralizer and swell packer system of claim 1, wherein the centralizer portion cured resin and bonded wellbore base tubular simultaneously (i) prevents axial movement of the centralizer portion about the wellbore base tubular, (ii) prevents rotational movement of the centralizer portion while installed on the wellbore base tubular, (iii) distributes load evenly preventing stress around the centralizer portion, and (iv) provides cathodic protection to the wellbore base tubular without using a stop collar fastened to the wellbore base tubular.

7. The field created integral electrically isolated centralizer and swell packer system of claim 1 wherein the plurality of blades are offset from each other.

8. The field created integral electrically isolated centralizer and swell packer system of claim 7, wherein a first row of blades is offset longitudinally 10 degrees to 60 degrees from a second row of blades disposed longitudinally along the outer surface of the hollow tube of the centralizer portion.

9. The field created integral electrically isolated centralizer and swell packer system of claim 1, wherein each blade comprises friction reducing diamond cutter inserts.

10. The field created integral electrically isolated centralizer and swell packer system of claim 9, wherein each flute is tapered at each end of the flute.

11. The field created integral electrically isolated centralizer and swell packer system of claim 1, wherein the blades extend away from the outer surface of the hollow tube 1% to 50% the thickness of the hollow tube from the outer surface of the centralizer portion.

12. The field created integral electrically isolated centralizer and swell packer system of claim 1, wherein each blade has a length from 1 time to 10 times greater than each blade width.

13. The field created integral electrically isolated centralizer and swell packer system of claim 1, wherein each blades forms an arc from 1 to 30 degrees from one end of the blade to the other end of the blade.

14. The field created integral electrically isolated centralizer and swell packer system of claim 1, wherein each blade has a hollow center longitudinally formed between the outer surface and a crest of each blade.

15. The field created integral electrically isolated centralizer and swell packer system of claim 14, comprising a diamond abrasion resistant hardfacing disposed on at least one of: at least a portion of the at least one crest of the blades of the centralizer portion, and a portion of an outer surface of each end ring.

16. The field created integral electrically isolated centralizer and swell packer system of claim 1, wherein the tubular swellable material comprises either:

a. an oil-swellable rubber, a natural rubber, a polyurethane rubber, an acrylate/butadiene rubber, a butyl rubber (IIR), a brominated butyl rubber (BIIR), a chlorinated butyl rubber (CIIR), a chlorinated polyethylene rubber (CM/CPE), an isoprene rubber, a chloroprene rubber, a neoprene rubber, a butadiene rubber, a styrene/butadiene copolymer rubber (SBR), a sulphonated polyethylene (PES), chlor-sulphonated polyethylene (CSM), an ethylene/acrylate rubber (EAM, AEM), an epichlorohydrin/ethylene oxide copolymer rubber (CO, ECO), an ethylene/propylene copolymer rubber (EPM), ethylene/propylene/diene terpolymer (EPDM), a peroxide crosslinked ethylene/propylene copolymer rubber, a sulphur crosslinked ethylene/propylene copolymer rubber, an ethylene/propylene/diene terpolymer rubber (EPT), an ethylene/vinyl acetate copolymer, a fluoro silicone rubber (FVMQ), a silicone rubber (VMQ), a poly 2,2,1-bicyclo heptene (polynorbornene), an alkyl styrene polymer, a crosslinked substituted vinyl/acrylate copolymer, derivatives thereof, or combinations thereof; or b. a water-and-oil-swellable material, and wherein the water-and-oil-swellable material comprises a nitrile rubber (NBR), an acrylonitrile/butadiene rubber, a hydrogenated nitrile rubber (HNBR), a highly saturated nitrile rubber (HNS), a hydrogenated acrylonitrile/butadiene rubber, an acrylic acid type polymer, poly (acrylic acid), polyacrylate rubber, a fluoro rubber (FKM), a perfluoro rubber (FFKM), derivatives thereof, or combinations thereof.

17. The field created integral electrically isolated centralizer and swell packer system of claim 1, wherein the flutes extend into the hollow tube of the centralizer portion from 2 percent to 90 percent of the thickness of the blade portion.

18. The field created integral electrically isolated centralizer and swell packer system of claim 1, wherein the end rings each comprise at least one of: one or more buttons of polycrystalline material, installed on an outer surface of each end ring, and friction reducing diamond cutter inserts installed on the outer surface of each end ring.

19. The field created integral electrically isolated centralizer and swell packer system of claim 1, comprising a plurality of flutes for each end ring, each end ring formed in parallel with the longitudinal axis of the swell packer portion.

20. The field created integral electrically isolated centralizer and swell packer system of claim 1, comprising a coating encapsulating each blade or partially disposed on each blade, wherein the coating is selected from the group consisting of: a curable polyurethane, or the cured resin and combinations thereof.

* * * * *